US005551178A

United States Patent [19]

Foley et al.

[11] Patent Number: 5,551,178

[45] Date of Patent: Sep. 3, 1996

[54] COLLAPSIBLE SIGN

[75] Inventors: James P. Foley, Kettering; Robert J. Nadeau, Dayton; Jan P. Ostendorf, Fairborn; Lawrence J. Whitehead, Dayton, all of Ohio

[73] Assignee: Flexsign Inc., Dayton, Ohio

[21] Appl. No.: 374,887

[22] Filed: Jan. 19, 1995

[51] Int. Cl.[6] ..... G09F 15/00

[52] U.S. Cl. ..... 40/610; 40/607; 248/431

[58] Field of Search ..... 248/431, 435, 248/440.1, 188.6; 403/330, 326, 321; 40/610, 607, 606

[56] References Cited

U.S. PATENT DOCUMENTS

| | | | |
|---|---|---|---|
| 351,990 | 11/1886 | Mansure . | |
| 2,246,750 | 6/1941 | Murphy | 403/326 X |
| 2,777,415 | 1/1957 | Martin et al. | 40/606 X |
| 2,793,453 | 5/1957 | Bixby . | |
| 3,312,432 | 4/1967 | Pfeiffer et al. | 248/188.6 X |
| 3,483,999 | 12/1969 | Barrett | 248/188.6 X |
| 3,527,434 | 9/1970 | Mauro . | |
| 3,638,894 | 2/1972 | Leutenegger | 40/606 X |
| 4,103,445 | 8/1978 | Smith et al. . | |
| 4,261,486 | 4/1981 | Bush et al. . | |
| 4,369,000 | 1/1983 | Egnew . | |
| 4,411,085 | 10/1983 | Farmer | 40/610 |
| 4,671,566 | 6/1987 | Knapp et al. | 248/188.6 X |
| 4,726,091 | 2/1988 | Joyce . | |
| 4,778,250 | 10/1988 | McRoskey et al. . | |
| 4,817,319 | 4/1989 | Vitale | 40/610 |
| 4,875,302 | 10/1989 | Noffsinger | 40/610 |
| 5,186,568 | 2/1993 | Falardeau | 403/330 X |
| 5,203,126 | 4/1993 | Sorenson et al. | 40/610 X |

*Primary Examiner*—Joanne Silbermann
*Attorney, Agent, or Firm*—H. Stanley Muir, III

[57] ABSTRACT

A collapsible sign includes a flexible banner supported by a collapsible stand. The collapsible stand, of A-frame configuration, includes two pairs of legs at each end of a cross-member, the apex of each leg pair and cross-member end retained in a unique one-piece connector. Each connector has two leg cups and a cross-member cup attached to a base block by a living hinge. A latch and saddle releasably secure the cross-member cup to the base block in the erected position. A cammed key and keyway releasably lock the leg cups to one another in the erected position. There is a slight interference fit between the cups which assists securing them in the erected position. In breaking down the sign, each leg pivots toward its paired partner upon release of the key from the keyway and the cross-member likewise pivots toward the legs upon release of the latch resulting in all legs and the cross-member being generally parallel to one another in the collapsed position. The flexible banner is wrapped about the cross-member and legs to form a compact bundle for ease in transporting and storage.

22 Claims, 3 Drawing Sheets

COLLAPSIBLE SIGN

BACKGROUND OF THE INVENTION

I. Field of the Invention

This invention relates to collapsible signs and stands and, in particular, to self standing A-frame signs with articulating joints.

II. Description of the Prior Art

Numerous collapsible A-frame signs have been devised. Examples of such signs are found in U.S. Pat. No. 351,990 to Mansure; U.S. Pat. No. 2,793,453 to Bixby; U.S. Pat. No. 3,527,434 to Mauro; U.S. Pat. No. 4,411,085 to Farmer; U.S. Pat. No. 4,778,250 to McRoskey et al.; and U.S. Pat. No. 4,875,302 to Noffsinger. Each discloses a collapsible sign in which legs are attached to each end of a cross-member and the cross-member either comprises or supports a sign. In each example, collapse entails pivoting the legs generally with respect to the cross-member to create a more planar configuration. The problem with each example is that even following collapse each unit is far from compact, the legs continue to extend approximately perpendicular to the cross-member.

While not of the A-frame design, other signs in the prior art have attempted to further reduce the size of the sign when not in use. An example of this is U.S. Pat. No. 4,103,445 to Smith et al. which discloses a flexible sign surface and legs removable from the cross-member so that they can be placed adjacent the cross-member and the flexible sign surface wrapped about the cross-member and the legs. While the unit is compact when knocked down, it requires considerable effort to erect, what with needing to insert the legs through the channels in the flexible sign surface sides then slipping the legs into the cross member.

SUMMARY OF THE PRESENT INVENTION

There is therefore a need in the art for a collapsible A-frame sign which will form a substantially cylindrical package without the need to disassemble the elements making up the sign.

Accordingly, it has been the objective of this invention to provide a new and improved A-frame sign and stand which incorporates a novel one-piece connector at each end of the sign stand's cross member, between the cross-member and the legs paired at that end, that connector permitting the paired legs to be easily and simply connected to one another at their apex and to the cross member while permitting the paired legs to move between a collapsed storage position generally parallel to one another and an erected extended position at an angle to one another and further permitting the cross member to move between a collapsed storage position generally parallel to both pairs of legs and an erected position generally perpendicular to both pairs of legs.

In accord with this objective, and in preferred form, the connector is of a one-piece configuration molded from an elastomer, e.g., polypropylene. The connector includes a block plate and three cups which depend from the edges of the upper surface of the block plate, each of the cups being adapted to receive a leg or cross-member in friction fit assembly. Each cup has at its base an ear having a narrowed cross-section forming a web at the intersection between the ear and the attaching edge of the block plate. This narrowed cross-section or web defines a hinge line between the cup and the block plate.

Atop the block plate is a saddle and a latch in opposing relation to the cup in which the cross-member end is fitted. The top of the cross-member cup has raised edges forming a channel diagonally across the cup top perpendicular to the hinge line for the cross-member cup. In the collapsed position, the centerline for the cross-member in the cup is generally perpendicular to the upper surface of the block plate. In the erected position, the cross-member cup is hinged down and back against the upper surface of the block plate to rest in the saddle, the latch sliding along the cup top in the channel and latching in position against the cylindrical wall of the cup top most distant from the base plate upper surface and in interfering relation with the channel walls. In the erected, latched position, the cross-member extends generally parallel to the upper surface of the block plate.

Atop one leg cup is a cammed key while atop the other is a keyway. In the erected position, the cammed key passes into the keyway passageway, the cam contacts the ceiling of the passageway and snaps in place in an interference fit relation with the passageway ceiling to releasably fasten the two leg cups together.

In use, the A-frame sign is movable between collapsed and erected positions through use of the integrally molded hinges in the connectors. In the erected configuration, the connectors create a rigid connection between the legs and the cross-member ends such that each element maintains its geometrical relationship to the other. This gives the sign a stable base and support. A rectangular flexible sign surface having a casing formed along one edge encloses the cross-member to drape down between the opposing pairs of locked legs in the erected position.

Breaking down the A-fram from the erected position to the collapsed position, the keyed cam of each connector is released allowing the paired legs to rotate toward one another and the latch of each connector is released to allow the cross member to be rotated toward the legs. This causes all rigid elements of the sign to form a tight grouping about which the flexible sign surface can be wrapped forming a compact, easily stored bundle with no loose parts to become lost or askew.

BRIEF DESCRIPTION OF THE DRAWINGS

Other objectives and advantages of this invention will be more apparent from the following detailed description taken in conjunction with the drawings in which.

DETAILED DESCRIPTION OF THE PREFERRED EMBODIMENT

Figure 1:
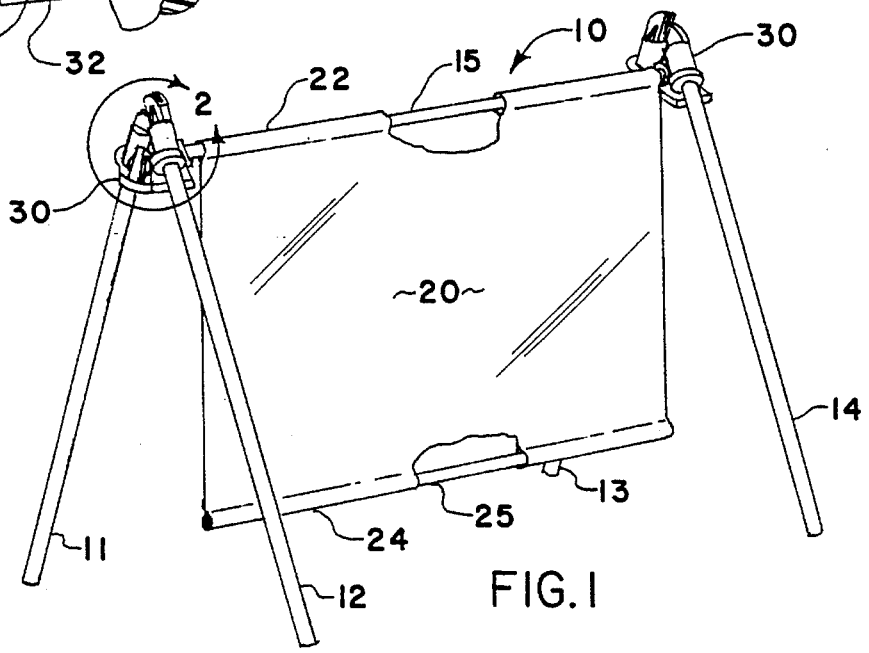
FIG. 1 is a perspective view of an A-frame sign that includes the novel connector, the sign being shown in the erected position.
Figure 3:
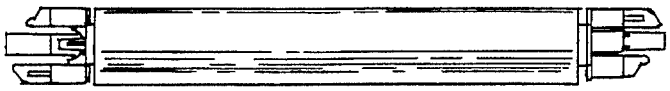
FIG. 3 is a front view of the A-frame sign in the collapsed position with the banner wrapped about the legs.

An embodiment of an A-frame sign 10 in accord with the principles of this invention is illustrated in FIG. 1 in its erected position and in FIG. 3. in its collapsed position. The sign includes a stand having four legs 11–14 and a cross-member 15 which assume an A-frame configuration when the sign is in the erected or set-up position shown in FIG. 1. Collectively, legs 11–14 and cross-member 15 are referred to as frame members. Each frame member is a rod of generally circular cross-section which in the preferred embodiment is made of fiberglass such as that manufactured by Precision Fiberglass Industries, 101 Park Avenue, P.O.Box 606 Newberry, S.C. under part numbers 629-27-V; 629-26.5-V; and 629-24-V.

As shown in FIG. 1, a rectangular flexible webbing or banner 20 forms the portion of the sign to which the desired message is typically applied. Banner 20 has a casing 22 formed along its upper edge through which cross-member 15 is inserted. In the preferred embodiment, the casing is created by folding a portion of the banner back against itself and sewing along the length of the banner near the top edge. Other methods of creating the casing such as heat sealing or adhesives are also usable. While not essential to the invention, in the preferred embodiment, a second casing 24 is similarly formed along the lower edge of banner 20 into which is inserted one or more weights 25. As illustrated in FIG. 1, when erected, the banner 20 hangs from the cross-member, the weights 25 holding the banner unfurled and resisting movement from the wind. In the preferred embodiment, weights 25 is a single rod of generally circular cross section similar to that of the frame members. While a variety of materials can be used for the banner, including cloth, paper and vinyl, in the preferred embodiment, the banner is made of layered vinyl with polyester scrim reinforcement such as that available from Snyder Manufacturing Inc., 3001 Progress Street, Box 188, Dover, Ohio, as PVR 1218Q Advertex Plus, 12 oz. fabric.

In the preferred embodiment, messages are silk-screened on the banner as is known in the art.

Figure 2:
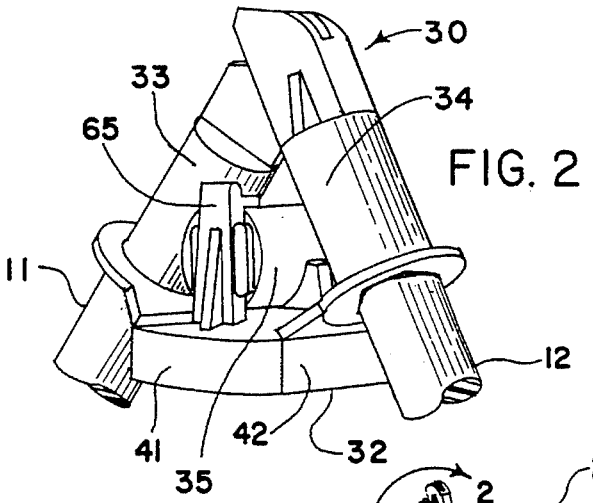
FIG. 2 is a perspective of the encircled area showing the connector in greater detail.

A connector 30 is attached to each end of the cross-member 15 and to the apex ends of leg pairs 11&12 and 13&14. As shown in FIG. 2, each connector 30 is an integrally formed one-piece unit preferably molded from an elastomer, e.g., a flexible polymer such as polypropylene, using a single two-piece die. In the preferred embodiment, the polypropylene used to form the connector is PRO-FAX 7531 available from Himont USA, Inc., 2801 Centerville Road, Wilmington, Del. Further discussion is directed to a single connector 30 but applies to both connectors.

Figure 4:
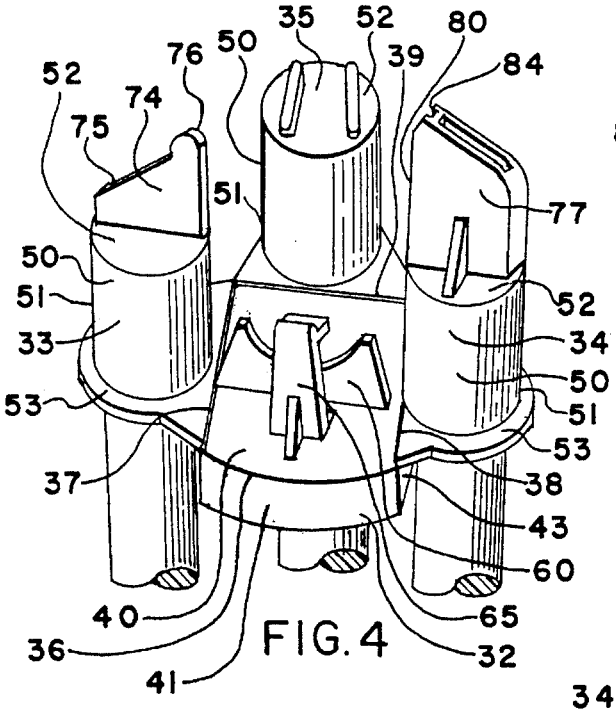
FIG. 4 is a top perspective view of the connector with its elements in the collapsed position.
Figure 5:
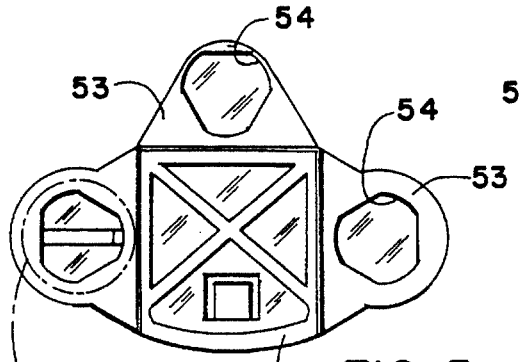
FIG. 5 is a bottom view of the novel connector with its elements in the collapsed position.

As shown in FIGS. 4&5, the central element of connector 30 is a base block 32 having a generally square top surface 40, defined by edges 36–39. About the top surface are generally rectangular sides 41–44 extending downward perpendicular to top surface 40. Leg cups 33 and 34 and cross-member cup 35 depend from base block top surface 40 at edges 37,38 & 39, respectively and are integrally molded therewith. As shown in FIG. 4, leg cups 33 and 34 depend from opposing top side edges 37 & 38, respectively.

Figure 6:
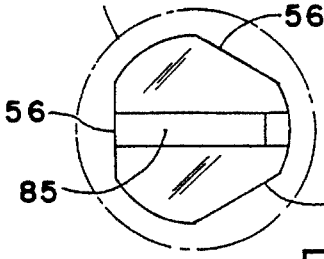
FIG. 6 is a detail of the encircled area of FIG. 5 illustrating the shape of the inner cylinder wall of the receiving cup.

Each cup 33,34&35 is comprised of a receiving cup 50 having an outer wall 51, a cup top 52 and a connecting ear 53. As shown in FIG. 5, viewed from beneath, for each cup 33,34&35, a bore defined by cup inner wall 54 penetrates ear 53 and terminates without penetrating cup top 52. As shown in FIG. 6, the generally cylindrical bore defined by cup inner wall 54 is broken by three equidistant protrusions, raised flats 56 extending the length of the bore. The diameter of the bore is sufficient for the associated frame member end to pass into and traverse down the bore while the protrusion of the flats 56 into the bore is sufficient to create a slight interference fit between the frame member end and the cup. In the preferred embodiment, the sizing of the members, the bore diameter and the protrusion of the flats are such that the members can be removed from the bore after assembly, if desired, but some effort is required to do so. Enabling the frame members to be removed from the connector permits, for example, replacement of banner 20 on cross-member 15 and substitution of legs 11–14 of various lengths as desired. Further, in the preferred embodiment, all frame members are constructed from the same rod stock which allow the members to be interchangeable and all cup bores to be identical thereby facilitating construction of the injection dies used in molding the connectors 30.

Figure 7:
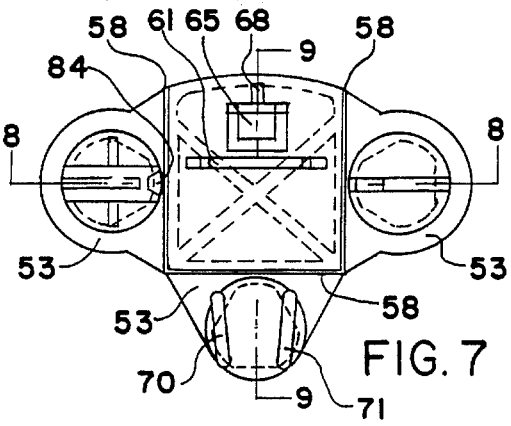
FIG. 7 is a top view of the novel connector showing the inner cylinder wall and base block support structure in phantom.
Figure 8:
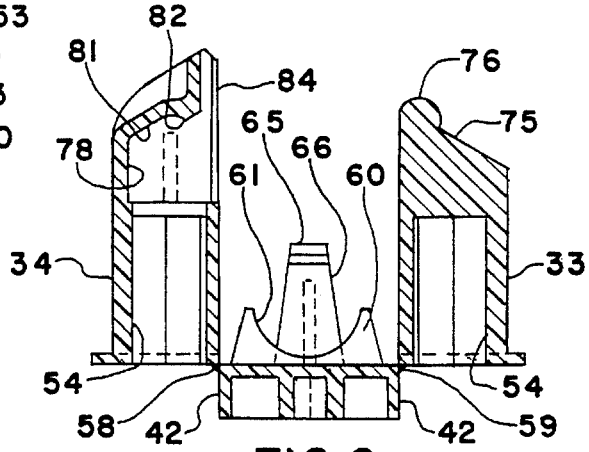
FIG. 8 is a cross-section taken along line 8—8 in FIG. 7.

Each ear 53 of cups 33,34&35 extends generally perpendicular to the centerline of the bore defined by cup inner wall 54 of each cup. As shonw in FIG. 4, each ear 53 intersects an edge 37,38 or 39 of the top surface 40 of base block 32. As shown in FIG. 7, the intersection between the respective ear 53 and the respective top side edge 37,38 or 39 defines a hinge line 58 and web between the base block 32 and the ear 53. In the preferred embodiment, as shown in FIG. 8, the web has a reinforcing gusset 59 molded into and extending between the associated base block side wall 42,43 or 44 beneath the respective edge 37, 38 or 39 and the underside of the ear 53 to increase hinge strength without affecting movement from the collapsed to erected positions of the cups 33–35. By virtue of the material used in constructing the connector, the web and gusset forms a living hinge about which the cup and base block can be flexed repeatedly without separation.

Figure 9:
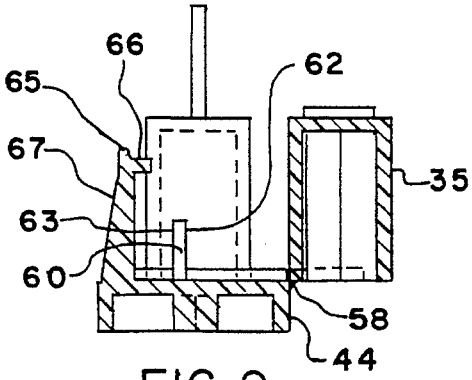
FIG. 9 is a cross-section taken along line 9—9 in FIG. 7.

Referring to FIGS. 7–9, the connector base block 32 includes on top surface 40 a saddle 60 having a generally semi-circular inner saddle surface 61 between horn sides 62 and 63. Horn side 62 is positioned toward cross-member cup 35, while horn side 63 faces in the opposite direction.

Figure 11:
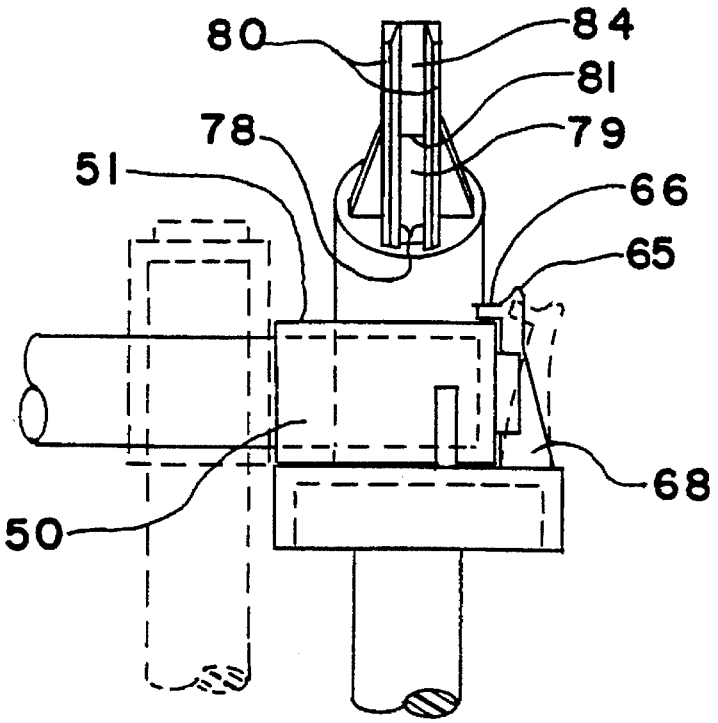
FIG. 11 is a cross-section taken along line 11—11 of FIG. 10 showing the cross-member and the cross-member cup in the erected position and, in phantom, the cross-member and cross-member cup in the collapsed position. Also shown is the latch in the locked position and, in phantom, the latch flexed to permit rotation of the cup from the erected to the collapsed position.

A latch 65, having a generally inverted "L" configuration with latch leg 66 facing cross-member cup 35, extends upwardly from top surface 40 in opposing relation to saddle horn side 63. Latch base 67 has a reinforcing gusset 68 on the side facing away from the cross-member cup 35. The angled shape of the reinforcing gusset 68 permits the upper portion of the latch back 67 to flex as the latch leg 66 contacts and traverses the cup top 52 as the cross-member cup 35 is moved from the collapsed to the erected position. As shown in FIG. 11, once the latch leg 66 passes over the edge of the cup top 52, it snaps back to its original position, locking against the outer wall 51 of the cross-member cup 50.

Figure 10:
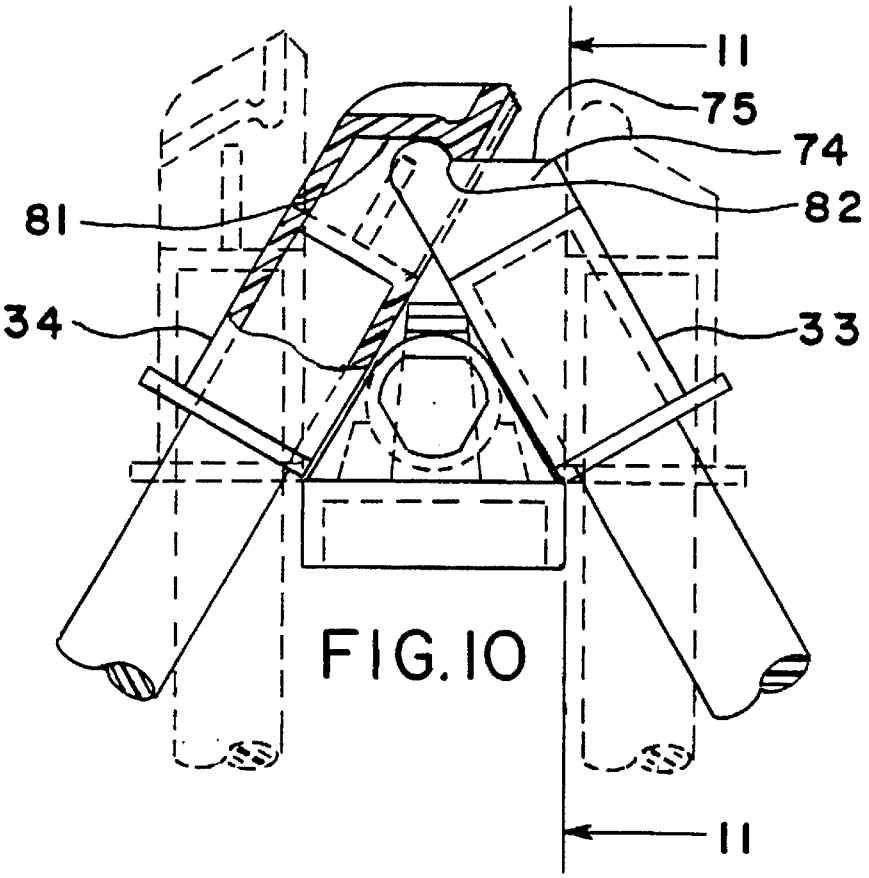
FIG. 10 is a side view of the connector and legs shown in the erected position with a cut-away to illustrate the cam-lock at the top of the leg cups and, in phantom, the leg cups in the collapsed position.

As shown in FIG. 7, extending along the cross member cup top 52 are two raised walls 70&71 which are oriented to extend parallel to the respective sides of latch back 67 when the connector elements are in the erected position. The interaction between raised walls 70&71 and the sides of latch back 67, coupled with the interaction between the inner saddle surface 61 with cross-member cup outer wall 51 stabilizes these connector elements with respect to one another, preventing flexure of cross-member cup 35 with respect to ear 53 and base block 32 when the cross-member cup 35 is latched in the erected position. In the preferred embodiment, as illustrated in FIG. 10, further stability between the connector elements is gained by configuring the leg cups 33&34 in the erected locked position such that their outer wall 51 presses slightly against the outer wall of the cross-member cup 35. Conversely, this interaction between the cross-member cup and the leg cups also assists in holding fast the cammed key 74 in keyway 77.

As shown in FIGS. 2,4 and 10, a cammed key 74 extends upwardly from leg cup 33. The cammed key 74 is centered along the diameter of cup top 52 at a right angle to edge 37 and extends the length of the diameter across the cup top 52. In profile, cammed key 74 has an angled top surface 75 the straightness of which is broken at its foremost end by a semicircular cam 76 extending upwardly therefrom.

As shown in FIGS. 4,10 and 11, a keyway 77 extends upwardly from leg cup 34. The keyway is centered along the diameter of cup top 52 at a right angle to edge 38 and extends the length of the diameter across the cup top 52. As shown in FIGS. 7&8, keyway 77 is penetrated by a passageway defined by inner walls 78 and ceiling 81. As shown in FIG. 11, the passageway extends inwardly from a generally rectangular opening 79 on face 80 opposing leg cup 33 to exit at the termination of the cup internal bore at a second generally rectangular opening 85, as shown in FIGS. 5&6. The keyway passageway is sized to permit penetration by a portion of the cammed key 74. Face 80 is further characterized by a channel 84, extending from top to bottom, of slightly greater width than key 74, in which the key 74 is slidably guided toward opening 79. In cross-section, as shown in FIG. 8, the passageway ceiling 81 at the entry from the opening 79 has a profile complementary to that of cam 76 and angled surface 75. The height of the key 74 and the passageway ceiling 81, coupled with the matching profiles of the cammed key and passageway ceiling, provide a slight interference fit as the cam 76 contacts the apex 82 of the angled portion and the curved portion of the ceiling 81. As the cam continues to penetrate the passageway, traveling beyond the apex 82, the interference fit causes the key 74 to latch in position against top inner wall 81, resting against the complementary profiles of the passageway top inner wall 81. As mentioned above, the latching action of the key in the passageway is augmented by the slight pressure of the cross-member cup against the leg cups when the elements are in the erected position.

Collapsing the sign is accomplished by first separating the connected leg cups 33 & 34, this done by applying pressure downwardly against the cup 33 and outwardly against the outer face 80 of cup 34. This is followed by pressing outwardly against latch 65 and rotating cross-member cup 35 away from saddle 60.

It bears pointing out that the unique connector 30 of the present invention is of one piece construction, all the above features being formed as an integral part of the connector using a single die. All elements and features of the connector are formed by the die in their respective collapsed positions and their shapes partially determined to facilitate removal from the die. For example, on the keyway 77 atop leg cup 34, passageway 83 penetrates cup top 52 to exit in the cup bore. This permits a single die leg to form both the bore and the passageway. Further, a square opening in base block top surface 40 permits a die leg to extend above the top surface 40 to assist in forming latch leg 66.

With the above description of the individual parts making up the A-frame sign, it can be readily seen that the sign can be quickly assembled by inserting a rod weight 25 into banner weight casing 24, sliding the cross-member 15 through banner casing 22, inserting the cross-member ends into cross-member cup 35 of connectors 30, and legs 11–14 into leg cups 33&34 of connectors 30.

Erection simply requires rotating cross-member cup 35 toward base block top surface 40 to be releasably secured in place against saddle 60 by latch 65; rotating cups 33&34 toward one another above top surface 40, allowing cam 76 to travel down along channel 84 to enter opening 79; applying pressure on leg cups 33&34 forcing them toward one another to cause cam 76 to traverse apex 82 to releasably latch in position against passageway ceiling 81.

Collapse is equally simple. Leg cups are separated by pushing keyway 77 away from cammed key 74; latch 65 is disengaged from cross-member cup 35 and cross-member cup 35 is rotated away from the base block top surface 40. This accomplished, paired legs 11&12 and 13&14 fold toward one another then fold toward cross-member 15. Banner 20 is then wrapped about the legs and cross-member to form an easily transportable and storable bundle as shown in FIG. 3.

The foregoing detailed description is given primarily for clearness of understanding and no unnecessary limitations should be understood therefrom for modifications will become obvious to one skilled in the art upon reading this disclosure and may be made without departing from the spirit of the invention or scope of the appended claims.

What is claimed:

1. For A-frame collapsible stands having a cross-member and two pairs of legs, a connector between the cross-member and a leg pair, comprising:

a base block having a top surface defined by edges;

a cross-member cup attached to the base block along one edge of the top surface by a living hinge for receiving an end of the cross member, the cross-member cup having a bore defined by an inner cup wall;

means for releasably latching the cross-member cup to the base block in an erected position;

a first leg cup attached by a living hinge to the base block along one edge of the top surface adjacent the edge to which the cross-member cup is attached, the first leg cup having a bore defined by an inner cup wall opening at the end of the first leg adjacent the base block;

a second leg cup attached by a living hinge to the base block along the other edge of the top surface adjacent the edge to which the cross-member cup is attached, the second leg cup having a bore defined by an inner cup wall opening at the end of the second leg cup adjacent the base block;

means for releasably connecting the first leg cup to the second leg cup in a predetermined erected position, wherein, in the erected position, the cross-member cup bore is perpendicular to the bore of the first cup and perpendicular to the bore of the second leg cup and, in the collapsed position, the bores of the cross-member cup and the leg cups are generally parallel to one another.

2. The connector of claim 1, in which an ear extends from each cup, each ear having an edge terminating at the living hinge intersection of the respective cup and the respective edge of the base block top surface.

3. The connector of claim 2, in which a gusset extends the length of the intersection between the respective ear and the respective edge of the base block top surface.

4. The connector of claim 3 in which the means for releasably latching the cross-member cup includes means for holding the cross-member cup at a desired position with respect to the base block top surface in the erected position.

5. The connector of claim 4, in which the means for releasably connecting the first leg cup to the second leg cup in a predetermined erected position comprises:

a key on the first leg cup; and a keyway having a passageway on the second leg cup, whereby, in the predetermined erected position, the key penetrates and interacts with the keyway passageway.

6. The connector of claim 5, in which:

the key extends upwardly from the end of the first leg cup opposing the end having the bore opening and has a straight top surface angled upwardly in the direction of the second leg cup broken by a semi-circular cam at the end of the top surface nearest the second leg cup; and the keyway on the second leg cup extends upwardly from the top of the second leg cup and has a side opposing the first leg cup through which the keyway passageway opens, the opening and passageway being of the same width as the key and having sufficient height to permit penetration by the key cam and a portion of the key top surface when the first leg cup and second leg cup are hinged toward one another; and the keyway passageway having walls and a ceiling complementary in configuration to the associated surfaces of the key, the ceiling of the passageway forming an apex at the intersection between an angled portion and a curved portion over which the semi-circular cam of the key traverses as pressure is applied to force the cups toward one another, then releasably locks on the innermost curved side of the apex in complementary relation to the passageway ceiling.

7. The connector of claim 6, in which the keyway is further characterized by a channel on the side of the keyway facing the opposing key of a width equal to that of the opposing key, which receives and contains the key as the key and keyway contact one another and along which the key slidably traverses to the passageway opening.

8. The connector of claim 7 in which the means for releasably latching the cross-member cup includes an inverted "L" shaped latch extending upwardly from the base block top surface and a latch leg extending generally perpendicular therefrom toward the cross-member cup, the height of the latch and length of the extended latch leg such that, in the erected position, the latch leg extends over the cross-member cup in interfering relation thereto to prevent rotation of the cup about the hinge away from the base block top surface.

9. The connector of claim 8, in which the means for holding the cross-member cup at a desired position is a saddle having an inner surface complementary to the outer configuration of the cross-member cup, the saddle extending upwardly from the top surface of the base block to contact the outer surface of the cross-member cup along some portion of its periphery in the erected position.

10. The connector of claim 9, in which the means for holding the cross-member cup at a desired position further includes a pair of walls on the top of the cross-member cup, the height, length and position of the walls such that, in the erected position, the walls contain and are in interfering relation with the latch sides to prevent sideways movement of the cross-member cup with respect to the base block.

11. The connector of claim 10, in which the cross-member cup is cylindrical in configuration at its outer surface and the saddle is semi-circular in profile, the diameters of the cylindrical cup surface and the semi-circular saddle surface complementary to one another to prevent sideways movement of the cross-member cup with respect to the base block.

12. The connector of claim 11, in which the configuration of the bore in each of the cups is cylindrical altered by at least one protrusion which extends into the bore to interact with a frame member inserted into the bore

13. The connector of claim 12, in which the at least one protrusion is three equidistant flats extending the length of the bore, whereby the bore accepts generally cylindrical members while the flats provide an interference fit between the members and the cup.

14. The connector of claim 13, in which the circumference of the cross-member cup, the circumference of the first leg cup and the circumference of the second leg cup are such that there is an interference fit at the intersection of the first leg cup with the cross-member cup and the second leg cup with the cross-member cup sufficient to press the cross-member cup against the saddle and the key against the ceiling of the keyway passageway to stabilize the elements of the connector in the collapsible erected position.

15. The connector of claim 1 in which the living hinge is polypropylene.

16. The connector of claim 15 in which the connector is of one piece construction.

17. An A-frame collapsible stand for posting signs, comprising:

a cross-member;

two pairs of legs;

a banner hung from the cross-member; and a one-piece connector between the cross-member and each leg pair, comprising:

base block having a top surface defined by edges;

a cross-member cup attached to the base block along one edge of the top surface by a living hinge for receiving an end of the cross member, the cross-member cup having a bore defined by an inner cup wall;

means for releasably latching the cross-member cup to the base block in an erected position;

a first leg cup attached by a living hinge to the base block along one edge of the top surface adjacent the edge to which the cross-member cup is attached, the first leg cup having a bore defined by an inner cup wall opening at the end of the first leg adjacent the base block;

a second leg cup attached by a living hinge to the base block along the other edge of the top surface adjacent the edge to which the cross-member cup is attached, the second leg cup having a bore defined by an inner cup wall opening at the end of the second leg cup adjacent the base block;

means for releasably connecting the first leg cup to the second leg cup in a predetermined erected position, wherein, in the erected position, the cross-member cup bore is perpendicular to the bore of the first cup and perpendicular to the bore of the second leg cup and, in the collapsed position, the bores of the cross-member cup and the leg cups are generally parallel to one another.

18. The A-frame stand of claim 17, in which the cross-member and the legs are cylindrical rods.

19. The A-frame stand of claim 18, in which the banner is comprised of flexible material.

20. The A-frame stand of claim 19, in which the means for releasably connecting the first leg cup to the second leg cup in a predetermined erected position comprises:

a key on the first leg cup; and a keyway having a passageway on the second leg cup, whereby, in the predetermined erected position, the key penetrates and interacts with the keyway passageway, the key extending upwardly from the end of the first leg cup opposing the end having the bore opening and having a straight top surface angled upwardly in the direction of the second leg cup broken by a semi-circular cam at the end of the top surface nearest the second leg cup; and the keyway on the second leg cup extending upwardly from the top of the second leg cup opposing the end having the bore opening and having a side opposing the first leg cup through which the keyway passageway opens, the opening and passageway being of the same width as the key and having sufficient height to permit penetration by the key cam and a portion of the key top surface when the first leg cup and second leg cup are hinged toward one another; and the keyway passageway having walls and a ceiling complementary in configuration to the associated surfaces of the key, the ceiling of the passageway forming an apex at the intersection between an angled portion and a curved portion over which the semi-circular cam of the key traverses as pressure is applied to force the cups toward one another, then releasably locks on the innermost curved side of the apex in complementary relation to the passageway ceiling; and the keyway further characterized by a channel on the side of the keyway facing the opposing key of a width equal to that of the opposing key, which receives and contains the key as the key and keyway contact one another and along which the key slidably traverses to the passageway opening.

21. The A-frame stand of claim 20 in which the means for releasably latching the cross-member cup includes an inverted "L" shaped latch extending upwardly from the base block top surface and a latch leg extending generally perpendicular therefrom toward the cross-member cup, the height of the latch and length of the extended latch leg such that, in the erected position, the latch leg extends over the cross-member cup in interfering relation thereto to prevent rotation of the cup about the hinge away from the base block top surface;

a saddle having an inner surface complementary to the outer configuration of the cross-member cup, the saddle extending upwardly from the top surface of the base block to contact the outer surface of the cross-member cup along some portion of its periphery in the erected position.

22. For A-frame collapsible stands having a cross-member and two pairs of legs, a one-piece connector between the cross-member and a leg pair, comprising:

a base block having a top surface defined by edges;

a cross-member cup attached to the base block along one edge of the top surface by a living hinge for receiving an end of the cross member, the cross-member cup having a bore defined by an inner cup wall;

a first leg cup attached by a living hinge to the base block along one edge of the top surface adjacent the edge to which the cross-member cup is attached, the first leg cup having a bore defined by an inner cup wall opening at the end of the first leg adjacent the base block;

a second leg cup attached by a living hinge to the base block along the other edge of the top surface adjacent the edge to which the cross-member cup is attached, the second leg cup having a bore defined by an inner cup wall opening at the end of the second leg cup adjacent the base block;

a key extending upwardly from the top of the first leg cup having a straight top surface angled upwardly in the direction of the second leg cup, broken by a semi-circular cam at the end nearest the second leg cup;

a keyway extending upwardly from the top of the second leg cup having a side opposing the first leg cup, the side having an opening to a passageway defined by inner side walls and a ceiling, the opening and passageway being of the same width as the key and having sufficient height to permit penetration by the key cam and a portion of the key top surface when the first leg cup and second leg cup are hinged toward one another;

the ceiling of the passageway forming an apex at the intersection between an angled portion adjacent the opening and a curved portion over which the semi-circular cam of the key traverses as pressure is applied to force the leg cups toward one another, then releasably locks on the innermost curved side of the apex in complementary relation to the passageway ceiling;

an inverted "L" shaped latch extending upwardly from the base block top surface and a latch leg extending generally perpendicular therefrom toward the cross-member cup, the height of the latch and length of the extended latch leg such that, in the erected position, the latch leg extends over the cross-member cup in interfering relation thereto to prevent rotation of the cup about the hinge away from the base block top surface;

a saddle having an inner surface complementary to the outer configuration of the cross-member cup, the saddle extending upwardly from the top surface of the base block to contact the outer surface of the cross-member cup along some portion of its periphery in the erected position;

the circumference of the cross-member cup, the circumference of the first leg cup and the circumference of the second leg cup having an interference fit at the intersection of the first leg cup with the cross-member cup and the second leg cup with the cross-member cup to thereby press the cross-member cup against the saddle and the key against the ceiling of the keyway passageway to stabilize the elements of the connector in the collapsible erected position;

the configuration of the bore in the cross-member cup and each leg cup being cylindrical altered by three equidistant flats extending the length of the bore, whereby the bore accepts generally cylindrical members while the flats provide an interference fit between the members and the cup, whereby, in the erected position, the cross-member cup bore is perpendicular to the bore of the first cup and perpendicular to the bore of the second leg cup and, in the collapsed position, the bores of the cross-member cup and the leg cups are generally parallel to one another.

* * * * *